United States Patent [19]

Harmathy

[11] Patent Number: 4,635,729

[45] Date of Patent: Jan. 13, 1987

[54] EXTENSIBLE FLAME DEFLECTOR

[75] Inventor: Tibor Z. Harmathy, Ottawa, Canada

[73] Assignee: Canadian Patents and Development Limited, Ottawa, Canada

[21] Appl. No.: 873,045

[22] Filed: Jun. 3, 1986

Related U.S. Application Data

[63] Continuation of Ser. No. 647,403, Sep. 4, 1984, abandoned.

[30] Foreign Application Priority Data

Sep. 9, 1984 [CA] Canada ..... 436406

[51] Int. Cl.[4] ..... A62C 7/00

[52] U.S. Cl. ..... 169/48; 49/7; 49/373; 49/379; 52/1; 52/64; 52/109; 169/42; 182/47

[58] Field of Search ..... 169/48, 54, 60, 42, 169/57; 52/1, 64, 109, 232; 49/1, 7, 31, 372, 373, 379; 160/19, 45, 50, 75, 83 D, 84 H, 84 V; 182/47, 76, 90

[56] References Cited

U.S. PATENT DOCUMENTS

| | | | |
|---|---|---|---|
| 151,855 | 6/1874 | Craw | 160/75 |
| 381,656 | 4/1888 | Thompson | 182/90 |
| 444,961 | 1/1891 | Puckett | 169/48 |
| 500,030 | 6/1893 | Niehaus | 182/84 |
| 1,021,330 | 3/1912 | Price | 160/83 D |
| 1,026,045 | 5/1912 | MacDowney | 160/75 |
| 1,413,596 | 4/1922 | Langdon | 160/75 |
| 2,573,160 | 10/1951 | Norman | 49/1 |
| 2,649,150 | 8/1953 | Hoke et al. | 160/84 H |
| 3,968,841 | 7/1976 | Harmathy | 169/42 |

*Primary Examiner*—Joseph F. Peters, Jr.
*Assistant Examiner*—Michael J. Forman
*Attorney, Agent, or Firm*—Francis W. Lemon

[57] ABSTRACT

A flame deflecting device that comprises a fire resistant lamina and a protective casing mountable on a building exterior in rows above windows. Each device has a width greater than the window below. When mounted on a building, the device does not extend vertically by more than three feet (0.9 m). When activated on the occurrence of fire, the flame resistant lamina is released and extended substantially horizontally from the building exterior, thereby deflecting flames, smoke and hot gases escaping from below.

6 Claims, 5 Drawing Figures

EXTENSIBLE FLAME DEFLECTOR

This application is a continuation of application Ser. No. 647,403, filed 4 Sept. 1984, now abandoned.

BACKGROUND OF THE INVENTION

This invention relates to a flame deflecting device for mounting on a building exterior.

A flame deflector was described by T. Z. Harmathy in an earlier U.S. Pat. No. 3,968,841. The justification for using flame deflectors on building exteriors was discussed at length in that patent so that this disclosure will largely deal with the advantages of the new flame deflector designs over those in U.S. Pat. No. 3,968,841.

The essential part of the flame deflector of U.S. Pat. No. 3,968,841 is a panel, mounted in an upwardly extending position above those "openings" of the building envelope where flames or hot gases are capable of emerging if fire occurs. These openings are normally windows, and occasionally balcony doors. The panel is held in an upwardly extending position by a flame- or heat-destructible element. If fire emerges from the building through an opening, the destruction of that element allows the panel to assume an essentially horizontally-extending position, thereby protecting the storeys above from exposure to flames or radiated heat.

It was said that to provide effective protection, the panel must be at least 3 feet (approx. 0.9 m) wide, preferably 4 ft (approx. 1.2 m) or more. Since the panels are mounted upwardly along the facade, accommodating them may present some difficulties for buildings built with vertical distances of less than 1.0 m between the openings. Unfortunately, these are the buildings most susceptible to the spread of fire from storey to storey along their facade, and therefore require special protection.

A new type of flame deflector has been designed for use where there is a need to provide protection against the external spread of fire in those buildings where the openings (usually windows) are closely spaced in the vertical direction.

SUMMARY OF THE INVENTION

According to the present invention, there is provided a building exterior mountable flame deflecting device comprising:

(a) a casing, mountable on a building, extending less than three feet, (b) when so mounted, containing, attached to the casing (b) a fire resistant lamina large enough to span a window, retained in said casing in a stored position by:

(c) lamina retaining means comprising a plate, secured to the casing (d) securing means releasable on the occurrence of fire; and, (e) lamina projecting means urging the lamina (b) against the plate when said lamina is stored in the casing and, upon release of securing means projecting the lamina to a substantially horizontally extending projected position.

BRIEF DESCRIPTION OF THE DRAWINGS

In the accompanying drawings, which illustrate by way of example, embodiments of the present invention.

DESCRIPTION OF THE INVENTION

Figure 1:
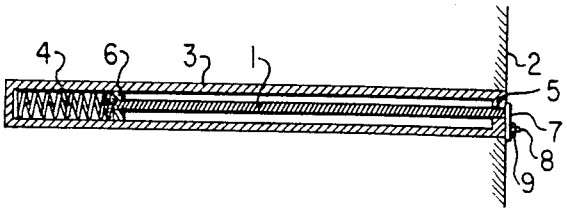
FIG. 1 is a sectional side view of a simple version of the flame deflecting device with the fire resistant lamina in the retracted position.
Figure 2:
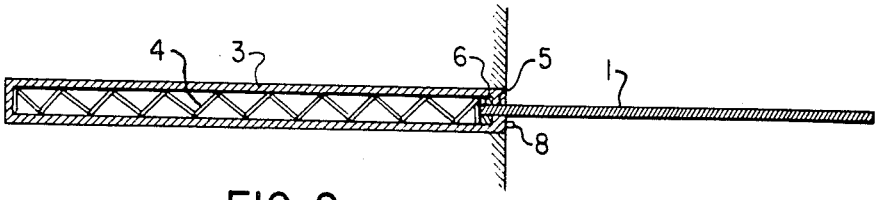
FIG. 2 is a sectional view of the flame deflecting device shown in FIG. 1 with the fire resistant lamina in the extended position.

Referring now to FIGS. 1 to 5, there are shown flame deflecting devices for mounting on a building exterior. FIGS. 1 and 2 show a flame deflecting device comprising:

(a) a fire resistant lamina 1 that is of a substantially rigid material and is stored extending substantially horizontally and that is of the required minimum width and length where the length of the fire resistant lamina 1 is taken as with the width of the opening, e.g. windows, above which the flame deflecting device is mounted, plus 4 feet (1.2 m) or a distance that the space left horizontally between the openings allows. A flame deflecting device of this type may have means of placing the fire resistant lamina in a substantially horizontally-extending position comprising at least one spring in the interior of the casing and urging the fire resistant lamina to the extended position, the fire resistant lamina possessing at least one stopper. The fire resistant lamina 1 is made of a material or combination of materials which is capable of withstanding fire exposure without significant deformation and damage for the average duration of a fully developed compartment fire (about 30 min). For simplicity, the fire resistant lamina shown in FIGS. 1 and 2 is shown as one made of a single material, (b) a mounting means by which the flame deflecting device is mounted on the building by being embedded in a wall 2, of a building to be protected, in rows above the windows, (c) the casing 3 whereby the fire resistant lamina 1 is protected when stored in the retracted position, (d) the springs 4 installed to spring load and force the fire resistant lamina 1 through an open side in the form of a slot 5 in the casing 3 when released from the horizontally retracted position, until the stopper 6 come into contact with the casing 3 whereby the fire resistant lamina 1 is fully extended and held substantially horizontally, which occurs upon thermal actuation of the flame deflecting device, (e) the strip 7 fastened to the casing 3 by a bolt 8 and a flame- or heat-destructible (e.g. fusible) nut 9 approximately midway along the length of the flame deflector device whereby the fire resistant lamina 1 is secured within the casing 3, and (f) the securing means is thermally actuated when fire breaks out by the flames or hot gases destroying the flame- or heat-destructible nut 9. The strip 7 is dislodged and the fire resistant lamina 1 is forced by the springs 4 to advance in the slot 5 until it is stopped by the stoppers 6. In this deployed position, the panel will protect the building from the spread of fire from storey to storey by deflecting flames impinging on the underside of the fire resistant lamina 1.

Where structural elements of a building or a proposed building make the installation of a flame deflecting device of the type illustrated in FIGS. 1 and 2 difficult, expensive or impossible, a flame deflecting device wherein the fire resistant lamina is of a substantially flexible material and is stored in the casing in a packed condition to be readily extendible to the substantially horizontally-extending position may be employed. The flame deflecting device may possess means of extending the fire resistant lamina to a substantially horizontally-extending position comprising at least one tong-like mechanism, and spring urging the tong-like mechanism to the substantially horizontally-extending position. Such a flame deflecting device may have the tong-like mechanism mounted with the axes of the pivots of the tong-like mechanism being substantially horizontal.

Figure 4:
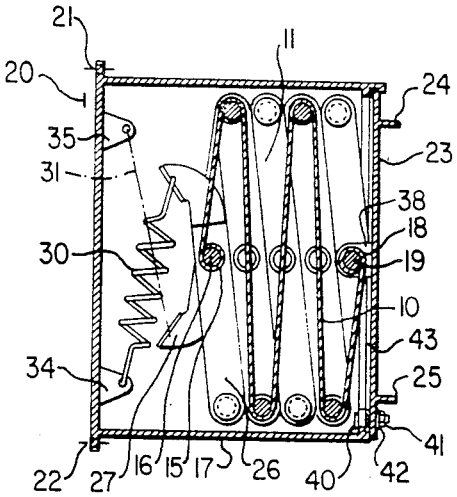
FIG. 4 is a sectional side view of the flame deflecting device of FIG. 3 with the fire resistant lamina in the retracted position.
Figure 3:
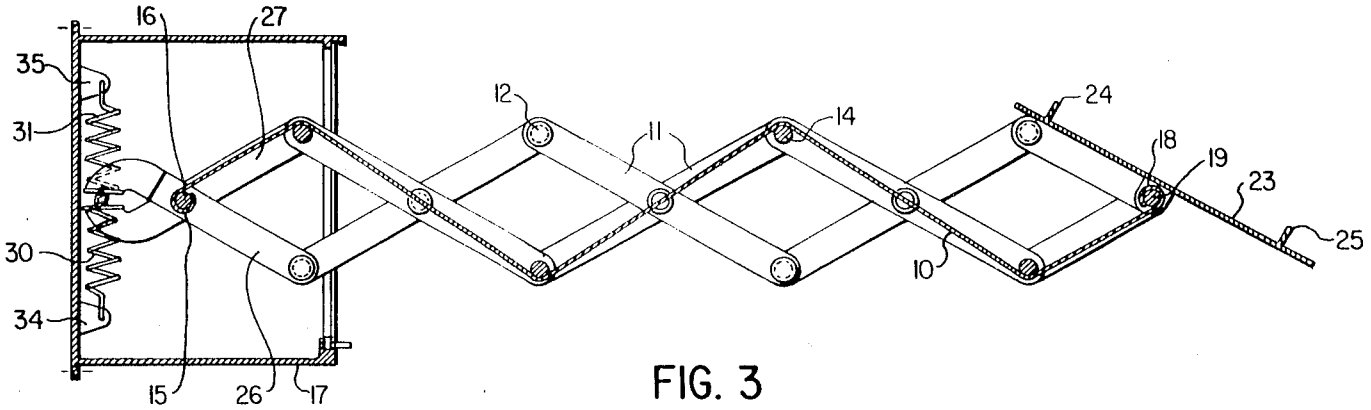
FIG. 3 is a partly sectional side view of a flame deflecting device with the fire resistant lamina in the extended position.
Figure 5:
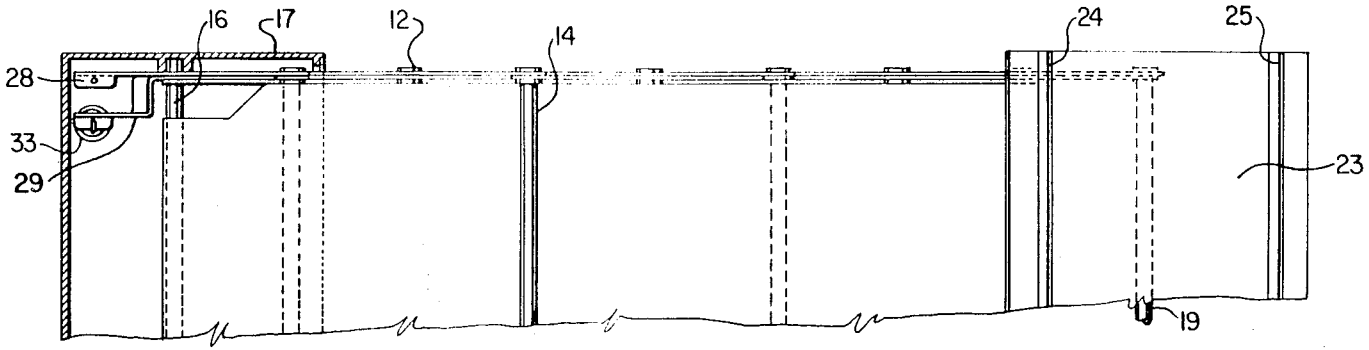
FIG. 5 is a view from above of the flame deflecting device of FIGS. 3 and 4 with fire resistant lamina in the extended position.

FIGS. 3, 4 and 5 show a flame deflecting device comprising:

(a) a fire resistant lamina 10 that is of a substantially flexible material, such as metal reinforced asbestos or ceramic cloth, mounted on a tong-lke mechanism, the tong-like mechanism comprising the following elements: a series of arms 11 joined together by short pins 12 and long rods 14, the long rods 14 connecting one side of the tong-like mechanism with the other side of the tong-like mechanism. The fire resistant lamina 10 is stretched out by the long rods 14. The proximal end 15 of the fire resistant lamina 10 is fastened to the rod 16, which is embedded at its ends in the casing 17. The distal end 18 of the fire resistant lamina 10 is fastened to the rod 19;

(b) a mounting means by which the flame deflecting device is mounted on a wall 20 of a building to be protected by means of an anchoring device for which holes 21, 22 are provided in the casing 17. The flame deflecting devices may be mounted in rows above the openings, usually windows, of the building to be protected;

(c) the casing 17 is closed by a lid 23 which is reinforced longitudinally by two webs 24 and 25 whereby the fire resistant lamina 10 is protected when stored in the retracted position;

(d) the arms 26, 27, 28 and 29 pivotally mounted on the rod 16 connected to the series of arms 11 by short pins 12 or long rods 14, and connected by the springs 30, 31, respectively, to the wings 34, 35, respectively, which are mounted in the casing 17 whereby the fire resistant lamina 10 is fully extended and held substantially horizontally upon actuation of the flame deflecting device;

(e) the lid 23 reinforced longitudinally by two webs 24 and 25 is attached by web 38 to the long rod 19 and is fastened to the casing 17 through a single bolt 40, a heat- or flame-destructible (e.g. fusible) nut 41 with a washer 42 placed between the nut 41 and the lid 23. A gasket 43 placed between the lid 23 and the casing 17 to ensure that all parts within the casing 17 are sealed air-tight from the atmosphere to protect them from corrosion; and (f) the securing means outlined in (e) above may be actuated when fire breaks out by the flames or hot gases destroying the heat or flame-destructible nut 41. This process can be speeded up by making the bolt 40 and the washer 42 of materials of low thermal conductivity. The springs 30, 31 contract and extend the tong-like mechanism to which they are linked by the arms 26, 27, 28 and 29 mounted on the rod 16. As a result, the fire resistant lamina 10 is extended to a substantially horizontally-extended position. The lid 23 moves with the tonglike mechanism and, as can be seen in FIG. 5, by extending the area of the flame deflecting device, increases the effectiveness of the flame deflecting device in protecting the building from spread of fire from storey to storey.

I claim:

1. A building-exterior mountable flame deflecting device comprising:

(a) a casing having an open side and mountable on a building to extend upwardly less than three feet when so mounted;

(b) a fire resistant lamina large enough to span a horizonftal width of a window and retained in said casing in a stored, horizontally retracted position and extendable therefrom through the open-side to a substantially horizontal position;

(c) lamina retaining means comprising a closure closing the open side of the casing;

(d) securing means releasably securing the closure in the casing, the securing means being thermally actuated on the occurrence of fire to release the closure and allow the lamina to emerge through the open side of the casing; and, (e) lamina projecting means enclosed within said casing spring loading the lamina to urge the lamina against the closure when said lamina is stored in the retracted position in the casing and upon thermal actuation of the securing means to release the closure, urging the lamina to and holding the lamina in, the substantially horizontal, extended position to deflect flames impinging on an underside thereof.

2. A flame deflecting device according the claim 1 wherein the fire resistant lamina is of a substantially rigid material and is stored extending substantially horizontally.

3. A flame deflecting device according to claim 2 wherein the lamina projecting means comprises at least one spring located in the casing.

4. A flame deflecting device according to claim 1 wherein the fire resistant lamina is of a substantially flexible material and is stored in the casing in a packed condition.

5. A flame deflecting device according to claim 4 wherein the lamina projecting means comprises at least one lazy-tong mechanism, and spring means urging the lazy-tong mechanism to the substantially horizontally-extending position.

6. A flame deflecting device according to claim 5 wherein the lazy-tong mechanism includes a plurality of pivots each having a pivotal axis, the pivotal axes being parallel and substantially horizontal.

* * * * *